US010064248B2

(12) United States Patent
Janik et al.

(10) Patent No.: US 10,064,248 B2
(45) Date of Patent: Aug. 28, 2018

(54) LIGHT FIXTURE WITH FERRORESONANT TRANSFORMER POWER SOURCE

(71) Applicant: Cooper Technologies Company, Houston, TX (US)

(72) Inventors: Raymond George Janik, Fayetteville, GA (US); Russell Scott Trask, Sharpsburg, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/456,046

(22) Filed: Mar. 10, 2017

(65) Prior Publication Data

US 2017/0265259 A1 Sep. 14, 2017

Related U.S. Application Data

(60) Provisional application No. 62/306,310, filed on Mar. 10, 2016.

(51) Int. Cl.
*H05B 41/16* (2006.01)
*H05B 33/08* (2006.01)

(52) U.S. Cl.
CPC ..... *H05B 33/0815* (2013.01); *H05B 33/0845* (2013.01); *H05B 33/0896* (2013.01)

(58) Field of Classification Search
CPC ..... H05B 41/2827; H05B 41/042; H05B 41/2822; H05B 41/282; H05B 41/34; H05B 33/0803; H05B 39/09; H05B 41/28; H05B 33/0809; H01F 38/10
See application file for complete search history.

(56) References Cited

U.S. PATENT DOCUMENTS 3,739,255 A * 6/1973 Leppert ..... G05F 3/06 323/248
4,144,462 A 3/1979 Sieron et al.
2005/0030192 A1 2/2005 Weaver
2011/0204820 A1 8/2011 Tikkanen et al.
2011/0222314 A1* 9/2011 Liu ..... H02M 3/156 363/15
2012/0249004 A1* 10/2012 Kamata ..... H05B 33/0818 315/206
2013/0113394 A1* 5/2013 Ido ..... H05B 33/086 315/297
2013/0119884 A1* 5/2013 Hung ..... H05B 33/0854 315/219
2015/0091472 A1* 4/2015 Kadotani ..... H05B 33/0815 315/294

OTHER PUBLICATIONS

PCT Search Report for PCT/2017/021868 dated Jun. 29, 2017.

* cited by examiner

*Primary Examiner* — Minh D A
(74) *Attorney, Agent, or Firm* — King & Spalding LLP

(57) ABSTRACT

A lighting device includes a ferroresonant transformer that receives an alternating current (AC) power signal and outputs an output power signal. The lighting device further includes a rectifier coupled to the ferroresonant transformer. The rectifier rectifies the output power signal from the ferroresonant transformer and generates a rectified power signal. The lighting device also includes a dc-to-dc converter coupled to the rectifier, wherein the dc-to-dc converter receives the rectified power signal and generates a regulated power signal.

21 Claims, 4 Drawing Sheets

LIGHT FIXTURE WITH FERRORESONANT TRANSFORMER POWER SOURCE

CROSS REFERENCE TO RELATED APPLICATIONS

The present application claims priority under 35 U.S.C. Section 119(e) to U.S. Provisional Patent Application No. 62/306,310, filed Mar. 10, 2016, and titled "Light Fixture With Ferroresonant Transformer Power Source," the entire content of which is incorporated herein by reference.

TECHNICAL FIELD

The present disclosure relates generally to voltage sources and more particularly, to ferroresonant transformer based DC voltage sources and lighting fixtures.

BACKGROUND

A Switch Mode Power Supply (SMPS) is often used to provide regulated power to load devices. SMPSs are designed to transfer electrical power from a power source, such as a mains supply, to a load, such as a lighting fixture. SMPSs that are rated under 200 W are generally widely available. However, such SMPSs tend to be prone to failure due to line surges and transients, particularly in outdoor applications. In many applications that use SMPSs, an external surge suppressor module is installed at the input of an SMPS to provide additional protection. External surge suppression modules can add a significant cost to a system and do not necessarily guarantee full protection against surges and transients. Further, SMPSs require a power factor correction stage to improve the power factor from a typical value of 0.5 to desirable values of greater than 0.9.

SMPSs that are rated for greater than 300 W are generally expensive and require relatively larger surge suppression modules, and the availability of such SMPSs is generally limited. Although SMPSs that support AC input range of 120V-277V are commonly available, large wattage SMPSs, i.e., SMPSs with larger input voltages, are not easily available off-the-shelf. In general, SMPSs with relatively larger AC input (e.g., 347V, 480V, 600V) are virtually nonexistent and are also challenging to implement. A common approach used to overcome the challenges of acquiring large wattage SMPSs is to use a linear step-down transformer at the input of a lower rated SMPS to lower the input voltage from 600V to the universal input voltage range of 120V-277V. Thus, a solution that eliminates the need for an external surge suppression module by providing surge suppression and that provides a high power factor, and that can be readily implemented for relatively high AC input voltages is desirable.

SUMMARY

The present disclosure relates generally to lighting solutions, and more particularly to improved utility of a lighting driver of a lighting device. In an example embodiment, a lighting device includes a ferroresonant transformer that receives an alternating current (AC) power signal and outputs an output power signal. The lighting device further includes a rectifier coupled to the ferroresonant transformer. The rectifier rectifies the output power signal from the ferroresonant transformer and generates a rectified power signal. The lighting device also includes a dc-to-dc converter coupled to the rectifier, wherein the dc-to-dc converter receives the rectified power signal and generates a regulated power signal.

In another example embodiment, a lighting fixture includes a ferroresonant transformer that receives an alternating current (AC) power signal and outputs an output power signal. The lighting fixture further includes a rectifier coupled to the ferroresonant transformer, where the rectifier rectifies the output power signal and generates a rectified power signal. The lighting fixture also includes a dc-to-dc converter coupled to the rectifier, where the dc-to-dc converter receives the rectified power signal and generates a regulated power signal. The lighting fixture further includes an LED light source coupled to the dc-to-dc converter, wherein the LED light source is powered by the regulated power signal.

In another example embodiment, a lighting fixture includes a ferroresonant transformer that receives an alternating current (AC) power signal and outputs an output power signal. The lighting fixture also includes a rectifier coupled to the ferroresonant transformer, where the rectifier rectifies the output power signal and generates a rectified power signal. The lighting fixture also includes an LED light source coupled to the rectifier, wherein the LED light source is powered by the rectified power signal.

These and other aspects, objects, features, and embodiments will be apparent from the following description and the appended claims.

BRIEF DESCRIPTION OF THE DRAWINGS

The foregoing and other features and aspects of the disclosure are best understood with reference to the following description of certain example embodiments, when read in conjunction with the accompanying drawings, wherein.

Figure 1:
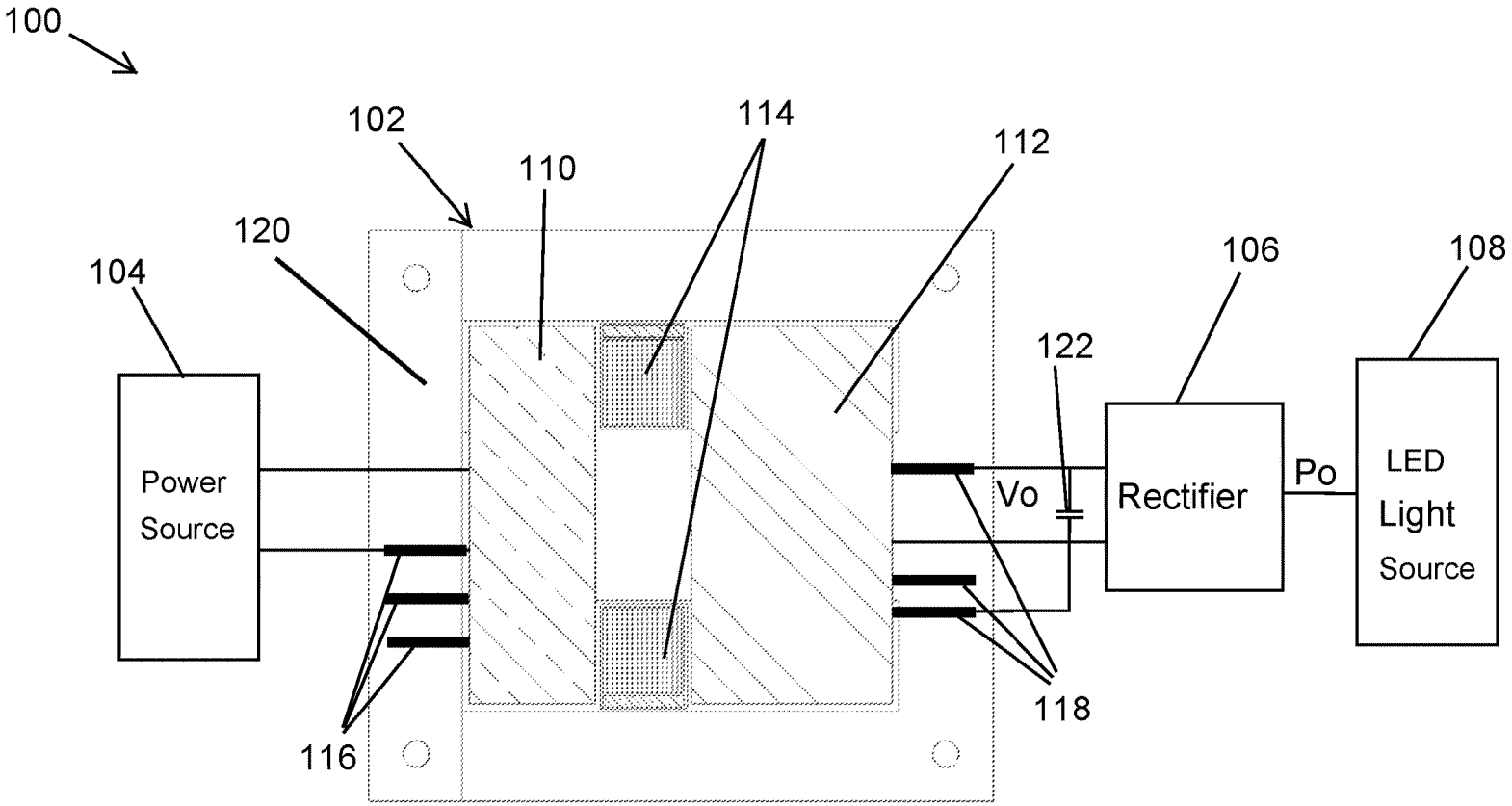
FIG. 1 illustrates a lighting device including a ferroresonant transformer according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the figures, the same reference numerals designate like or corresponding, but not necessarily identical, elements.

DETAILED DESCRIPTION OF EXAMPLE EMBODIMENTS

In the following paragraphs, particular embodiments will be described in further detail by way of example with reference to the figures. In the description, well known components, methods, and/or processing techniques are omitted or briefly described. Furthermore, reference to various feature(s) of the embodiments is not to suggest that all embodiments must include the referenced feature(s).

Turning now to the drawings, FIG. 1 illustrates a lighting device 100 including a ferroresonant transformer 102 according to an example embodiment. Referring to FIG. 1, the lighting device 100 includes a ferroresonant transformer 102 and a rectifier 106. The rectifier 106 is coupled to the output of the ferroresonant transformer 102 and rectifies an output power signal, Vo, provided by the ferroresonant transformer 102 to generate a rectified power signal, $P_O$, that is provided to an LED light source 108. The ferroresonant transformer 102 may generate the output power signal from an input AC power signal received by the ferroresonant transformer 102.

To illustrate, the ferroresonant transformer 102 may be coupled to a power source 104 as illustrated in FIG. 1. For example, the power source 104 may include power equipment (e.g., a metering device, circuit breaker, etc.) that is connected to a power line of a utility company that provides the input AC power signal to the ferroresonant transformer 102. Alternatively or in addition, the power source 104 may include a transformer, such as a transformer of a utility company. In some example embodiments, the power source 104 may include a generator or another device that provides an AC power signal to the ferroresonant transformer 102.

In some example embodiments, the rectifier 106 may be coupled to the LED light source 108. For example, the rectified power signal, $P_O$, provided to the light source 108 may be less than 60 V. The lighting device 100 may be an LED lighting fixture, such as an outdoor LED lighting fixture. For example, the lighting device 100 may be an LED street lamp. Alternatively, the lighting device 100 may be an indoor LED lighting fixture.

In some example embodiments, the LED light source 108 may include one or more discrete light emitting diodes (LEDs), one or more organic LEDs (OLEDs), an LED chip on board that includes one or more discrete LEDs, and/or an array of discrete LEDs. For example, the LED light source 108 may include multiple discrete LEDs or arrays of LEDs that are on a single printed circuit board (PCB). Alternatively, the light source 108 may include LEDs that are on multiple PCBs without departing from the scope of this disclosure. In some example embodiments, the LED light source 108 may also include different color LEDs. In some alternative embodiments, the LED light source 108 may be replaced by a light source that does not use LEDs without departing from the scope of this disclosure.

In some example embodiments, the input AC power signal provided to the ferroresonant transformer 102 by the power source 104 may have a voltage ranging from 120 V to 277 V. In some alternative embodiments, the input AC power signal may have a voltage that is more than 300V. For example, the input AC power signal may have a voltage of 347V, 480V, 600V, or 1000V.

As illustrated in FIG. 1, the ferroresonant transformer 102 includes a primary winding 110, a secondary winding 112, and a core 120. Magnetic shunts 114 may be positioned in a gap separating the primary winding 110 and the secondary winding 112. The magnetic shunts 114 enable the magnetic flux at the primary winding 110 to be different from the magnetic flux at the secondary winding 114. When a power signal from the power source 104 is provided to the primary winding 110, the voltage at the secondary winding 112 increases until the portion of the core 120 at the secondary winding 112 is saturated while the portion of the core 120 at the primary winding 110 remains unsaturated.

In contrast to conventional transformers, the leakage inductor effect at the magnetic shunts 114 of the ferroresonant transformer 102 and the large physical separation of the primary and secondary windings limits the transfer of magnetic flux from the primary winding 110 to the secondary winding 112, which significantly attenuates the transfer of transient voltages, such as transient voltages due to power surge, from the primary winding 110 to the secondary winding 112. Specifically, the leakage inductance introduced by the magnetic shunts, in conjunction with the resonance capacitor 122, acts as a high "Q" band pass filter centered at 60 Hz (50 Hz), which attenuates transients, suppresses surges and filters abnormalities in the power such as low power factor, harmonics, frequency variations, and voltage variations. The large physical separation between coils provides excellent non-destructive protection against high voltage transients caused by lightning strikes. Because the output power signal, Vo, provided to the rectifier 106 by the ferroresonant transformer 102 resembles a square wave, a relatively small smoothing capacitor (for example, the capacitor 204 shown in FIG. 2) may be used to further shape the rectified power signal from the rectifier 106.

In some example embodiments, the ferroresonant transformer 102 may also include input taps 116 and output taps 118. The power source 104 is connected to one of the input taps 116, and the rectifier 106 is connected to one of the output taps 118. The power source 104 provides the input power signal to the ferroresonant transformer 102 via the particular input tap of the input taps 116 that is connected to the power source 104, and the ferroresonant transformer 102 provides the output power signal to the rectifier 106 via the particular output tap of the output taps 118 that is connected to the rectifier 106.

The turn ratio of the primary winding 110 and the secondary winding 112 depends on the particular input tap 116 and output tap 118 that are selected for the lighting device 100. For example, the voltage level of the output power signal provided to the rectifier 106 by the ferroresonant transformer 102 may depend on the particular input tap of the input taps 116 that is coupled to the power source 104. To illustrate, the voltage level of the output power signal provided to the rectifier 106 can be changed by connecting the rectifier 106 to a different output tap of the output taps 118.

The voltage level of the output power signal provided to the rectifier 106 by the ferroresonant transformer 102 may also depend on the particular output tap of the output taps 118 that is coupled to the rectifier 106. To illustrate, the voltage level of the output power signal provided to the rectifier 106 can be changed by changing the particular input tap 116 that is connected to power source 104. The output of the ferroresonant transformer 102 is current limited, due to the presence of the large leakage inductance, which increases the output impedance. As a result, the ferroresonant transformer 102 is very forgiving for loads with constant voltage that are significantly less that the output voltage of the ferroresonant transformer 102.

In some example embodiments, the voltage level of the output power signal, Vo, from the ferroresonant transformer 102 may have a higher voltage level when the LED light source 108 is not coupled to the rectifier 106 than when the LED light source 108 is coupled to the rectifier 106. To illustrate, in some example embodiments, the ferroresonant transformer 102 may adjust, without losing proper regulation, the voltage level of the output power signal, Vo, based on the combined forward voltage of the LEDs of the LED light source 108. As a non-limiting example, if the voltage across the LED light source 108 is approximately 100 V, the ferroresonant transformer 102, which may be designed to support a 105 V load, may adjust the voltage level of the output power signal to match the 100 V load. In general, the ferroresonant transformer 102 may output the output power signal at a lower voltage level than a maximum possible voltage level or a nominal voltage level of the output power signal in response to a forward voltage of LEDs of the LED light source 108 being less than the maximum possible voltage level or less than the nominal voltage level of the output power signal, Vo.

The ferroresonant transformer 102 includes a parallel resonant energy storage section that acts as a buffer for non-linear loads. The parallel resonant part of the ferroresonant transformer 102 consists of the input inductance of the transformer and the resonance capacitor 122. Use of the ferroresonant transformer 102 in the lighting device 100 provides relatively high input power factor and surge protection that is not provided by conventional transformers. By eliminating the need for external power surge protection modules that are often required with SMPSs and by avoiding the power factor correction stage of SMPSs, the lighting device 100 can be a cost effective lighting device in contrast to another lighting device that includes an SNIPS. Further, because the lighting device 100 can accommodate relatively large input voltage levels, an external step-down transformer that may be required at the input of more commonly available SMPSs, is eliminated.

Although a particular number of input and output taps of the ferroresonant transformer 102 are shown in FIG. 1, in alternative embodiments, the ferroresonant transformer 102 may have more or fewer taps without departing from the scope of this disclosure. Although a single LED light source is shown in FIG. 1, the output of the rectifier 106 may provide power to multiple light sources without departing from the scope of this disclosure. For example, the light source 108 may include multiple independent light sources. In some alternative embodiments, the ferroresonant transformer 102 may have a different structure than shown in FIG. 1 without departing from the scope of this disclosure.

Figure 2:
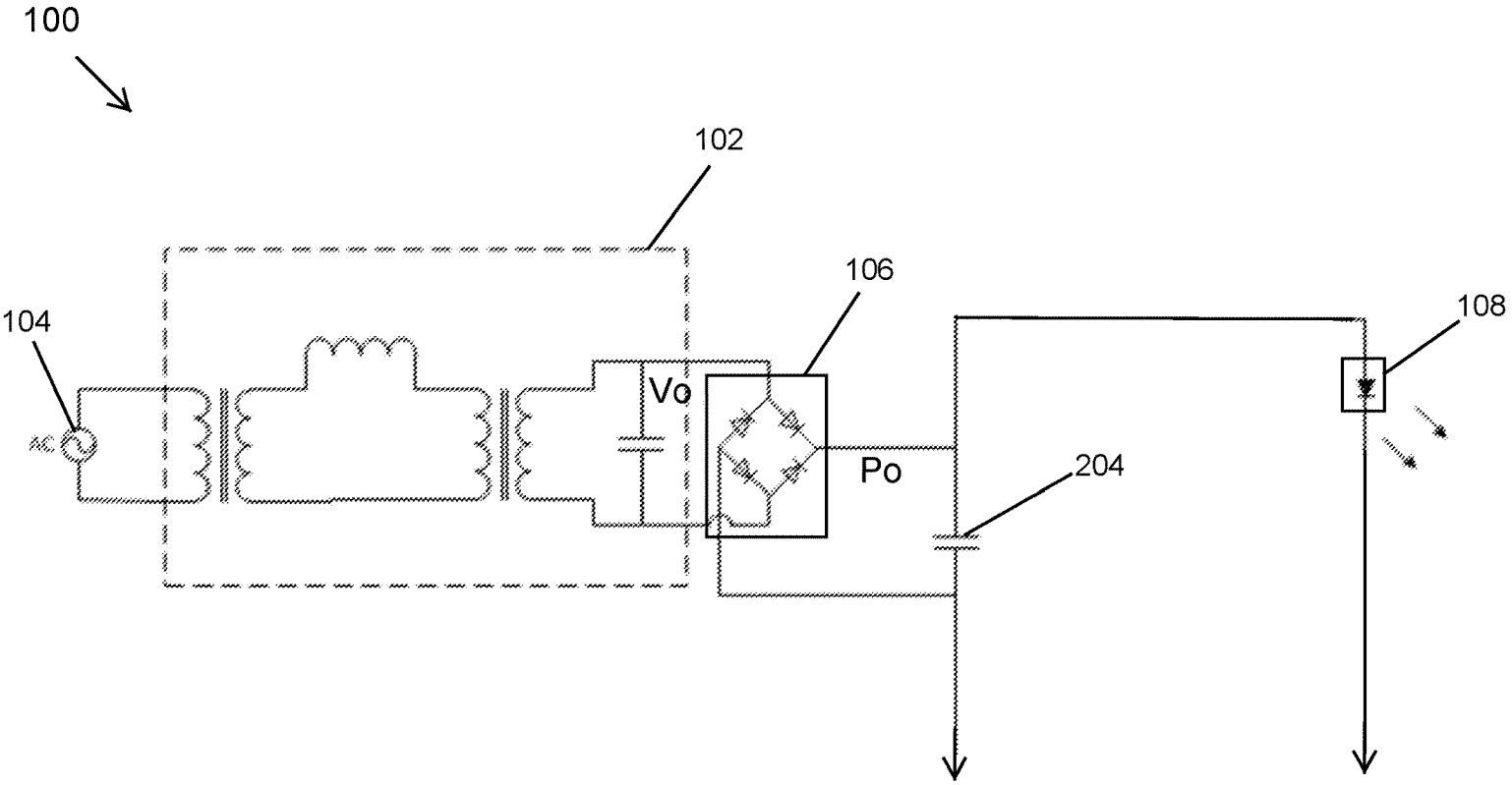
FIG. 2 illustrates the lighting device of FIG. 1 with a schematic representation of the ferroresonant transformer according to an example embodiment.

FIG. 2 illustrates the lighting device 100 of FIG. 1 with a schematic representation of the ferroresonant transformer 102 according to an example embodiment. Referring to FIGS. 1 and 2, the ferroresonant transformer 102 is coupled to the power source 104 and to the rectifier 106. The rectifier 106 rectifies the output power signal, Vo, from the ferroresonant transformer 102 and provides the rectified power signal to the LED light source 108. In some example embodiments, the lighting fixture 100 includes a capacitor 204 that is coupled in parallel with the light source 108. For example, the capacitor 204 may serve to reduce the ripple feeding into the LED load 108 and therefore reduce flicker in the light emitted by the light source 108. In some example embodiments, the capacitor 204 may have a capacitance value in the range of a few microFarads up to thousands of microFarads, depending on the target ripple current. In some alternative embodiments, the capacitor 204 may be omitted without departing from the scope of this disclosure. In some applications, light flicker may be visible in the absence of a smoothing capacitor such as the smoothing capacitor 204.

In some example embodiments, the ferroresonant transformer 102 may be used as shown in FIG. 1 in applications where a conventional transformer may be unsatisfactory or requires additional costly components. To illustrate, in contrast to conventional transformers, the ferroresonant transformer 102 of the lighting device 100 has an intentional large leakage inductance between the primary and secondary that electrically resonates with an externally connected capacitor 122 that may be, for example, an oil-filled self-healing type of capacitor. Resonance drives the secondary voltage to increase, bounded only by the saturation of the core 120 at the secondary winding 112. The flux density of the secondary winding 112 is chosen so that the voltage at saturation is the target voltage (i.e., the desired output voltage of the ferroresonant transformer 102).

As the core 120 at the secondary winding 112 saturates, the current in the resonant capacitor winding will exhibit high peaks. Since the capacitor voltage is proportional to the time-integral of the current, the portion of the voltage coinciding with the high peak current will rise fast, making the voltage waveform of the output power signal, Vo, approach that of a square wave, requiring a far smaller capacitance following the rectifier 106. In addition, since the flux at the secondary winding is held constant when the core 120 at the secondary winding saturates, the time-integral of the voltage is also constant, which results in a constant half cycle average voltage. As a result, the rectified output signal, $P_O$, from the rectifier 106 has a constant average (DC) value. For example, a voltage regulation between 5% and 10% can be achieved by the configuration of the ferroresonant transformer 102 and the rectifier 106 shown in FIG. 1. If better regulation is required, a switch mode DC to DC converter can be implemented, which can also provide dimming and other lighting controls (e.g., DALI, DMX, 0-10V, etc.). The lighting device 100 can achieve adequate voltage regulation for many applications while also providing surge suppression and power factor correction features.

Figure 3:
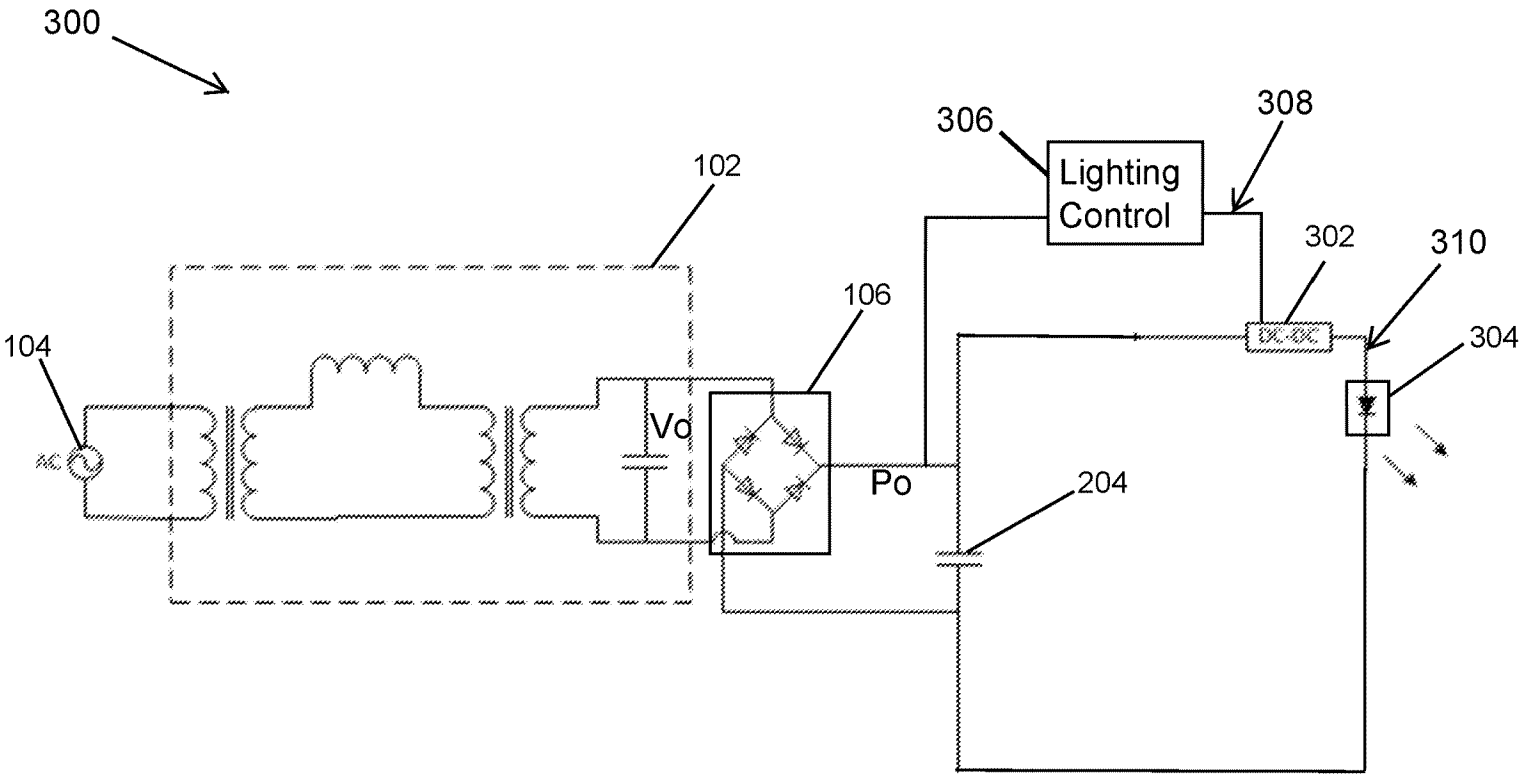
FIG. 3 illustrates a lighting device including a ferroresonant transformer and a DC-to-DC converter according to another example embodiment.

FIG. 3 illustrates a lighting device 300 including the ferroresonant transformer 102 and a DC-to-DC converter 302 according to another example embodiment. As illustrated in FIG. 3, the lighting device 300 includes the ferroresonant transformer 102 and the rectifier 106 described above with respect to FIGS. 1 and 2. For example, the ferroresonant transformer 102 may be coupled to the power source 104 as described above. To illustrate, the ferroresonant transformer 102 may receive an input AC power signal from the power source 104 that has a voltage level in the range of 120 V to 277 V or higher. In some alternative embodiments, the input AC power signal from the power source 104 may have a voltage level in excess of 300 V or less than 120 V.

In some example embodiments, the lighting device 300 includes dc-to-dc converter 302 that is coupled to the rectifier 106. The rectifier 106 receives the output power signal, Vo, from the ferroresonant transformer 102 and generates the rectified power signal, Po, that is provided to the dc-to-dc converter 302. The dc-to-dc converter 302 operates to generate a regulated DC power signal from an input DC signal as readily understood by those of ordinary skill in the art with the benefit of this disclosure. The lighting control 306 may be implemented as an interface with Connected Lighting devices.

In some example embodiments, the lighting device 300 includes the capacitor 204 that is coupled to the rectifier 106. For example, the capacitor 204 may serve to shape the rectified power signal, $P_O$, to reduce amplitude variations of the rectified power signal. To illustrate, the capacitor 204 may reduce ripples in the rectified power signal, $P_O$. In some alternative embodiments, the capacitor 204 may be omitted without departing from the scope of this disclosure.

In some example embodiments, the dc-to-dc converter 302 is coupled to an LED light source 304. The dc-to-dc converter 302 receives the rectified power signal, Po, from the rectifier 106 and generates the regulated power signal that is provided to the light source 304 via a connection 310. For example, the voltage level of the regulated power signal provided to the light source 304 may be less than 60 V.

Alternatively, the voltage level of the regulated power signal provided to the light source 304 may be above 60 V.

In some example embodiments, the LED light source 304 may be the same or substantially the same as the LED light source 108 of FIG. 1. For example, the lighting device 300 may be an LED lighting fixture, such as an outdoor LED lighting fixture (e.g., an LED street lamp). Alternatively, the lighting device 300 may be an indoor LED lighting fixture.

In some example embodiments, the dc-to-dc converter 302 can provide improved control over power management of the light source 304. For example, the dc-to-dc converter 302 may provide a better voltage regulation than can be provided by the ferroresonant transformer 102 alone.

In some example embodiments, the dc-to-dc converter 302 may provide controllability of the lighting device 300. For example, dimming and other control functionalities (e.g., powering on or off of the light source 304) may be performed via the dc-to-dc converter 302. To illustrate, the lighting device 300 may include a lighting control component 306 that is used to control the light emitted by the light source 304. As illustrated in FIG. 3, the lighting control component 306 may be coupled to the rectifier 106. For example, the lighting control component 306 may be powered by the rectified power signal, Po. Alternatively, the lighting control component 306 may not be coupled to the rectifier 106.

In some example embodiments, the lighting control component 306 may receive inputs from a user and accordingly control the dc-to-dc converter 302 to adjust the current or voltage level of the regulated power signal. For example, the lighting control component 306 may receive, wirelessly or via a wired connection, lighting control commands and may control the dc-to-dc converter 302 by providing a lighting control signal (e.g., a dim signal) to dc-to-dc converter 302 via a connection 308. The lighting control component 306 may have a user input interface and/or may include a sensor (e.g., a motion sensor, a light sensor, etc.) that is used to control the light output of the light source 304 by controlling the dc-to-dc converter 302. In some example embodiments, the lighting control component 306 may be integrated in the dc-to-dc converter 302.

In some example embodiments, the dc-to-dc converter 302 may operate as a voltage source, where the regulated power signal provided by the dc-to-dc converter 302 to the light source 304 via the connection 310 is a constant voltage signal that is independent of changes in the load presented by the light source 304. As described above, the voltage level of the regulated power signal may be adjustable, for example, using the lighting control component 306. For example, the voltage level of the regulated power signal may be increased or decreased to increase or decrease, respectively, the brightness of the light emitted by the light source 304.

In some example embodiments, the dc-to-dc converter 302 may be used to provide the regulated power signal at a different voltage level than the voltage level of the rectified power signal, $P_O$, and the output power signal, Vo.

In some example embodiments, the dc-to-dc converter 302 may operate as a current source and provide a regulated current to the LED light source 304. That is, the regulated power signal provided to the LED light source 304 by the dc-to-dc converter 302 via the connection 310 may be a constant current signal that is independent of changes in the load presented by the LED light source 304. As described above, the amount of current provided by the dc-to-dc converter 302 to the light source 304 may be adjustable, for example, by or using the lighting control component 306. For example, the amount of current provided by the dc-to-dc converter 302 may be increased or decreased to respectively increase or decrease (i.e., dim) the brightness of the light emitted by the light source 304 in response to a user input provided to the lighting control component 306.

The lighting device 100 provides the advantages described above with respect to the lighting device 100 with the added benefit of providing additional power regulation. The ferroresonant transformer 102, the rectifier 106, and the dc-to-dc converter 302 may be used with LED light sources other than the light source 304 without departing from the scope of this disclosure. In some example embodiments, another LED light source may be coupled to the dc-to-dc converter 302 and may be powered by the regulated power signal without departing from the scope of this disclosure.

In some example embodiments, the LED light source 304 may be a light fixture, such as an outdoor light fixture, or the lighting device 300 or some of the components of the lighting device 300 may be a lighting fixture.

In some example embodiments, the lighting control component 306 may be coupled to the dc-to-dc converter 302 in a different manner than shown in FIG. 3 without departing from the scope of this disclosure. Further, in some embodiments, the lighting device 300 may include other components that shown. For example, a switch or other components may be coupled between the rectifier 106 and the dc-to-dc converter 302.

Figure 4:
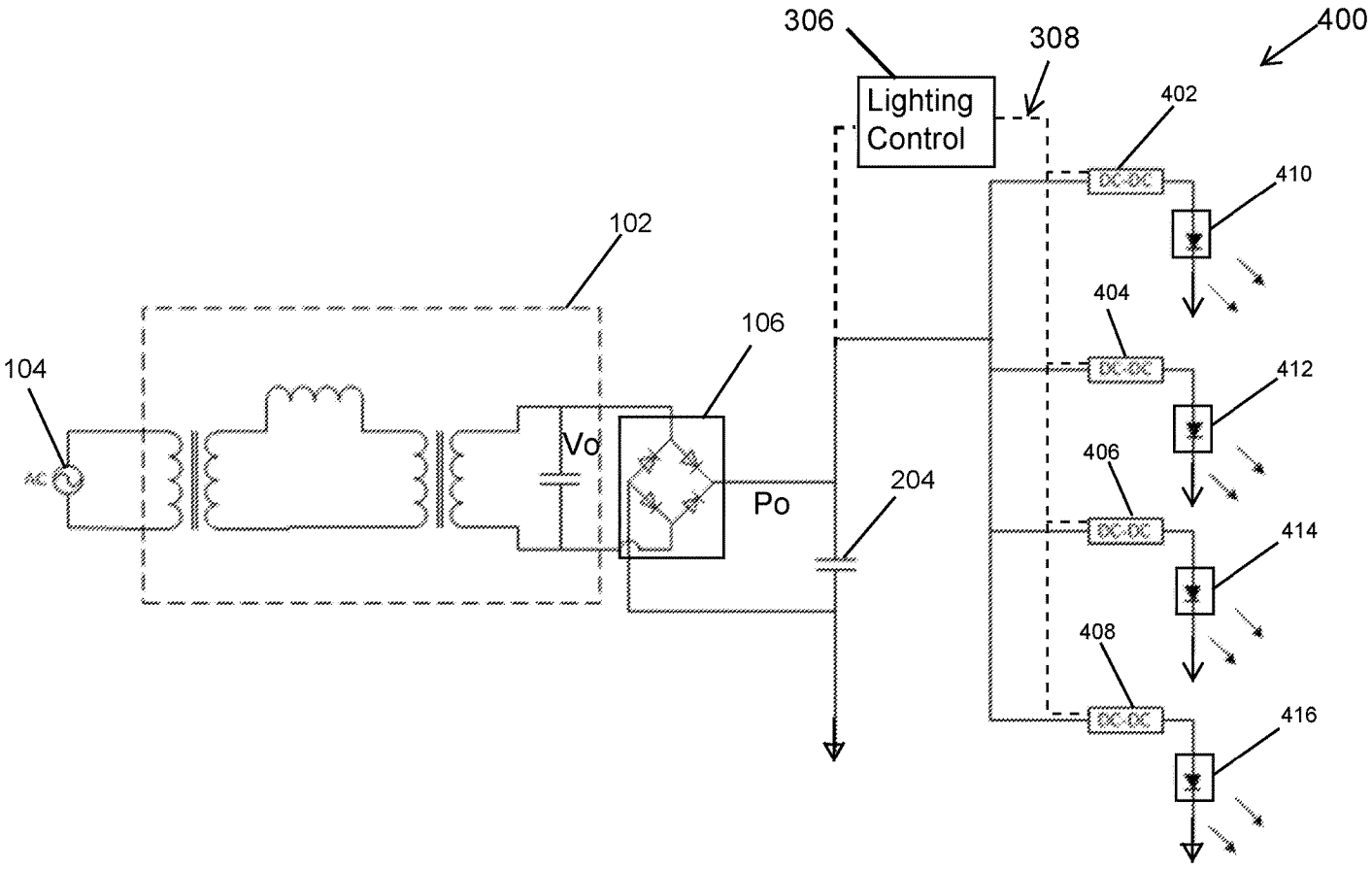
FIG. 4 illustrates a lighting device including a ferroresonant transformer and multiple DC-to-DC converters according to another example embodiment.

FIG. 4 illustrates a lighting system 400 including the ferroresonant transformer 102 and multiple DC-to-DC converters according to another example embodiment. As illustrated in FIG. 4, the lighting system 400 includes the ferroresonant transformer 102 and the rectifier 106 described above with respect to FIGS. 1-3. For example, the ferroresonant transformer 102 may be coupled to the power source 104 as described above. The ferroresonant transformer 102 may receive an input AC power signal from the power source 104 that has a voltage level in the range of 120 V to 277 V or higher. The lighting device 400 also includes the capacitor 204 that is coupled to the rectifier 106 as described above.

In some example embodiments, the lighting system 400 includes a dc-to-dc converter 402 that is coupled to and provides a regulated power signal to an LED light source 410 in a similar manner as described with respect to the dc-to-dc converter 302 and the light source 304. The lighting system 400 includes a dc-to-dc converter 404 that is coupled to and provides a regulated power signal to an LED light source 412. The lighting system 400 may also include a dc-to-dc converter 406 that is coupled to and provides a regulated power signal to an LED light source 414. The lighting device 400 may further include a dc-to-dc converter 408 that provides a regulated power signal to an LED light source 416. The dc-to-dc converters 402, 404, 406, 408 may each correspond the dc-to-dc converter 302 described above with respect to FIG. 3 and may operate in substantially the same manner. The LED light sources 410, 412, 414, 416 may correspond to the LED light source 108 of FIGS. 1 and 2 or to the LED light source 304 of FIG. 3 and may operate in substantially the same manner.

In some example embodiments, the regulated power signals generated by the dc-to-dc converters 402, 404, 406, 408 have different DC voltage levels from each other. For example, the regulated power signal generated by the dc-to-dc converter 402 may have a voltage level of 36 V, the regulated power signal generated by the dc-to-dc converter 404 may have a voltage level of 42 V, etc.

In some example embodiments, the dc-to-dc converters 402, 404, 406, 408 may provide controllability of the LED light sources 410, 412, 414, 416. For example, dimming and other control functionalities (e.g., powering on or off) of the lights emitted by the LED light sources 410, 412, 414, 416 may be performed. To illustrate, the lighting device 400 may include the lighting control component 306 described above with respect to the lighting device 300. For example, the lighting control component 306 may control the dc-to-dc converters 402, 404, 406, 408 individually, for example, to color tune of the combined light that is the combination of the lights emitted by some or all of the LED light sources 410, 412, 414, 416.

In some example embodiments, the lighting control component 306 may receive inputs from a user and control the dc-to-dc converters 402, 404, 406, 408 to adjust the current or voltage level of the regulated power signal from each one of the dc-to-dc converters 402, 404, 406, 408. For example, the lighting control component 306 may control each one of the dc-to-dc converters 402, 404, 406, 408 independently.

In some example embodiments, one or more of the dc-to-dc converters 402, 404, 406, 408 may operate as a voltage source or as a current source that is adjustable using the lighting control component 306 in a manner described above with respect to the dc-to-dc converter 302.

In some example embodiments, one or more of the LED light sources 410, 412, 414, 416 may emit different color light than the others. In some example embodiments, each one of the LED light sources 410, 412, 414, 416 may be a light fixture, such as an outdoor light fixture, or the lighting device 400 or some of the components of the lighting device 400 including some of the LED light sources may be incorporated in a single lighting fixture.

Although example embodiments have been described, it is to be construed that any features and modifications that are applicable to one embodiment are also applicable to the other embodiments. Furthermore, although the disclosure has been described with reference to specific embodiments, these descriptions are not meant to be construed in a limiting sense. Various modifications of the disclosed embodiments, as well as alternative embodiments of the disclosure will become apparent to persons of ordinary skill in the art upon reference to the description of the example embodiments. It should be appreciated by those of ordinary skill in the art that the conception and the specific embodiments disclosed may be readily utilized as a basis for modifying or designing other structures or methods for carrying out the same purposes of the disclosure. It should also be realized by those of ordinary skill in the art that such equivalent constructions do not depart from the spirit and scope of the disclosure as set forth in the appended claims. It is therefore, contemplated that the claims will cover any such modifications or embodiments that fall within the scope of the disclosure.

What is claimed is:

1. A lighting device, comprising:

a ferroresonant transformer that receives an alternating current (AC) power signal and outputs an output power signal, wherein the AC power signal received by the ferroresonant transformer has an input voltage level that is at least 300 VAC;

a rectifier coupled to the ferroresonant transformer, wherein the rectifier rectifies the output power signal and generates a rectified power signal; and a dc-to-dc converter coupled to the rectifier, wherein the dc-to-dc converter receives the rectified power signal and generates a regulated power signal.

2. The lighting device of claim 1, wherein the dc-to-dc converter operates as a current source and wherein the regulated power signal is a constant current signal.

3. The lighting device of claim 2, wherein an amount of current provided by the dc-to-dc converter is adjustable.

4. The lighting device of claim 1, wherein the dc-to-dc converter operates as a voltage source and wherein the regulated power signal is a constant voltage signal.

5. The lighting device of claim 1, further comprising a lighting control component that controls the dc-to-dc converter to adjust the regulated power signal.

6. The lighting device of claim 1, wherein the regulated power signal has a different voltage level than the rectified power signal.

7. The lighting device of claim 1, further comprising a second dc-to-dc converter that is coupled to the rectifier and that converts the rectified power signal to a second regulated power signal.

8. The lighting device of claim 1, further comprising a smoothing capacitor coupled to the rectifier, wherein the smoothing capacitor reduces a magnitude of ripples in the regulated power signal.

9. The lighting device of claim 1, wherein the rectified power signal has an output voltage level that is more than 60 V.

10. A lighting fixture, comprising:

a ferroresonant transformer that receives an alternating current (AC) power signal and outputs an output power signal, wherein the AC power signal received by the ferroresonant transformer has an input voltage level that is at least 300 VAC;

a rectifier coupled to the ferroresonant transformer, wherein the rectifier rectifies the output power signal and generates a rectified power signal;

a dc-to-dc converter coupled to the rectifier, wherein the dc-to-dc converter receives the rectified power signal and generates a regulated power signal; and an LED light source coupled to the dc-to-dc converter, wherein the LED light source is powered by the regulated power signal.

11. The lighting fixture of claim 10, wherein the dc-to-dc converter operates as a current source and wherein the regulated power signal is a constant current signal.

12. The lighting fixture of claim 11, wherein an amount of current provided by the dc-to-dc converter to the LED light source is adjustable to change a dim level of a light emitted by the LED light source.

13. The lighting fixture of claim 10, further comprising a lighting control component that controls the dc-to-dc converter to change a dim level of a light emitted by the LED light source.

14. The lighting fixture of claim 10, further comprising a second dc-to-dc converter that is coupled to the rectifier and that converts the rectified power signal to a second regulated power signal.

15. The lighting fixture of claim 10, wherein the rectified power signal has an output voltage level that is more than 60 V.

16. A lighting fixture, comprising:

a ferroresonant transformer that receives an alternating current (AC) power signal and outputs an output power signal;

a rectifier coupled to the ferroresonant transformer, wherein the rectifier rectifies the output power signal and generates a rectified power signal; and an LED light source coupled to the rectifier, wherein the LED light source is powered by the rectified power signal, wherein the ferroresonant transformer comprises multiple output taps corresponding to different output voltage levels, wherein a voltage level of the output signal of the ferroresonant transformer provided to the rectifier is changeable by changing a connection of the rectifier from a first tap of the multiple taps to a second tap of the multiple taps.

17. The lighting fixture of claim 16, further comprising a smoothing capacitor coupled in parallel with the LED light source, wherein the smoothing capacitor reduces a magnitude of ripples in the regulated power signal.

18. The lighting fixture of claim 16, wherein the AC power signal received by the ferroresonant transformer has an input voltage level at least 300 VAC and wherein the rectified power signal has an output voltage level that is more than 60 V.

19. A lighting fixture, comprising:

a ferroresonant transformer that receives an alternating current (AC) power signal and outputs an output power signal;

a rectifier coupled to the ferroresonant transformer, wherein the rectifier rectifies the output power signal and generates a rectified power signal; and an LED light source coupled to the rectifier, wherein the LED light source is powered by the rectified power signal, wherein the ferroresonant transformer outputs the output power signal at a lower voltage level than a maximum possible voltage level of the output power signal in response to a forward voltage of LEDs of the LED light source that is less than the maximum possible voltage level of the output power signal.

20. The lighting fixture of claim 19, wherein the AC power signal received by the ferroresonant transformer has an input voltage level at least 300 VAC and wherein the rectified power signal has an output voltage level that is more than 60 V.

21. The lighting fixture of claim 19, further comprising a smoothing capacitor coupled in parallel with the LED light source, wherein the smoothing capacitor reduces a magnitude of ripples in the regulated power signal.

* * * * *